US005234360A

United States Patent [19]

Kramer, Jr.

[11] Patent Number: 5,234,360

[45] Date of Patent: Aug. 10, 1993

[54] MULTIPLE OUTLET EXTENSION CORD

[75] Inventor: Wayne A. Kramer, Jr., Altoona, Pa.

[73] Assignees: Robert V. Smith, Altoona; Michael A. Brown, Shirleysburg, both of Pa.

[21] Appl. No.: 905,551

[22] Filed: Jun. 25, 1992

[51] Int. Cl.[5] ..... H01R 11/00

[52] U.S. Cl. ..... 439/505; 439/502; 439/367

[58] Field of Search ..... 439/502, 505, 892, 135, 439/142, 367

[56] References Cited

U.S. PATENT DOCUMENTS

| | | | |
|---|---|---|---|
| 1,512,888 | 10/1924 | Haft . | |
| 1,758,982 | 5/1930 | Seghers . | |
| 1,818,884 | 8/1931 | Eckstein | 439/505 |
| 1,974,472 | 9/1932 | Seghers | 439/505 |
| 2,201,045 | 5/1940 | Lundstrom | 439/505 |
| 2,976,524 | 3/1961 | Wall . | |
| 3,535,638 | 10/1970 | Michelin | 324/149 |
| 3,890,836 | 6/1975 | McKenzie et al. | 73/168 |
| 4,083,621 | 4/1978 | Davidson et al. | 339/119 |
| 4,099,824 | 7/1978 | Schoppelrey | 339/157 |
| 4,477,801 | 10/1984 | Robinson, Jr. et al. | 340/684 |
| 4,941,845 | 7/1990 | Eppley et al. | 439/505 |
| 4,955,822 | 9/1990 | Look et al. | 439/505 |

FOREIGN PATENT DOCUMENTS

| | | | |
|---|---|---|---|
| 9010319 | 9/1990 | World Int. Prop. O. | 439/505 |

*Primary Examiner*—Paula A. Bradley

*Attorney, Agent, or Firm*—Webb, Burden, Ziesenheim & Webb

[57] ABSTRACT

A flexible electric extension cord having a main cable with a plug connected at one end and a socket connected at the other end. A plurality of flexible pigtails connected at spaced intervals along the main cable and having a socket connected to the free end. The extension cord is utilized to conduct electricity to electricity consuming devices which are connected to the sockets.

6 Claims, 3 Drawing Sheets

MULTIPLE OUTLET EXTENSION CORD

BACKGROUND OF THE INVENTION

1. Field of the Invention

The invention relates generally to an electric extension cord and more particularly to an electric extension cord having an elongated main cable and plurality of individual cables or pigtails spaced along and electrically connected to the main cable with a socket at the distal end to receive the plug of an electricity consuming device.

2. Description of Prior Art

Prior art electric extension cords generally have a plug on one end and a socket on the opposite end. The prior art extension cords have lengths varying from a few feet up to 100 feet. The prior art also discloses rigid adapters having a single plug to be plugged into a 110 volt outlet and multiple adjacent outlets for receiving plugs from electricity consuming devices.

SUMMARY OF THE INVENTION

The invention provides an elongated electric extension cord having a flexible main cable and a plurality of flexible individual cables or pigtails spaced along its length and electrically connected to it. Each pigtail is provided with a socket at the distal end so that the extension cord can be used at construction sites where power tools are simultaneously required at different locations for different applications. Power tools are generally provided with a relatively short cord with a plug on the free end and therefore require a long extension cord so that they can be connected to a source of electricity such as a generator or a pole outlet. Rather than providing a single extension cord for each power tool, the extension cord of the invention has a plurality of spaced cables with individual sockets which avoids the problems created by having a number of separate elongated extension cords extending from the source of electricity which can become tangled and thereby create a generally dangerous condition.

The extension cord of the invention may be grounded and can have any reasonable length. The pigtails are electrically connected in parallel along the length of the cord at desired spacings depending upon the use and length of the cord. The cord may be made from 10, 12 or 14 gauge stranded copper wire depending upon the length of the cord in order to permit the cord to supply electricity to a plurality of tools, appliances or other electricity consuming devices. The cord may also be used by trucking firms to provide electricity to a plurality of engine block heaters to maintain the truck engine blocks at a sufficiently high temperature to facilitate starting the engines in cold weather.

The extension of the invention cord is covered with an outer layer of waterproof insulation so that it can be used out of doors and each socket may be constructed with external threads adjacent its free end to receive internally threaded caps to prevent moisture and dirt from entering the socket openings when the socket is not in use and thereby prevent short circuiting of the socket.

A complete understanding of the invention will be obtained from the following description when taken in connection with the accompanying drawings wherein like reference characters identify like parts throughout.

DETAILED DESCRIPTION OF THE DRAWINGS

DESCRIPTION OF THE PREFERRED EMBODIMENTS

Figure 1:
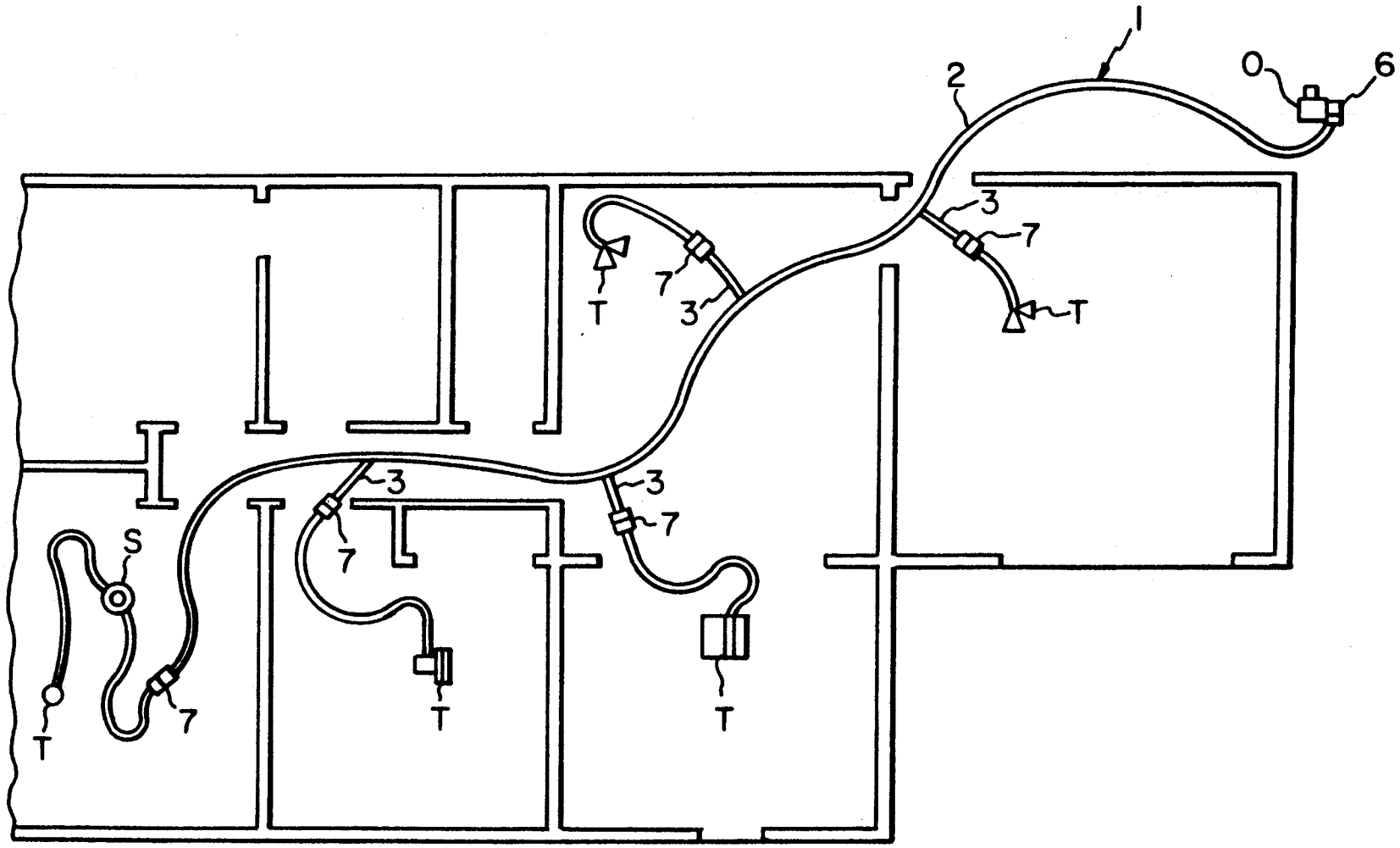
FIG. 1 is a plan view of a multiple outlet extension cord at a construction site where power tools are connected to the pigtails.

With reference to FIG. 1 of the drawings, an elongated electric extension cord 1 has a flexible main cable 2 and a plurality of flexible pigtails 3 are electrically connected to the main cable at spaced locations along the length of the main cable. One end of the main cable has a polarized plug 6 electrically connected thereto and the distal end of each pigtail 3 has a polarized socket 7 electrically connected thereto. A polarized socket 7 is also electrically connected to the end of main cable 1 opposite to the end to which plug 6 is connected. Each socket 7 is adapted to receive the grounded plug on a cord from a tool T as shown in FIG. 1 of the drawings. The cord from the tool which is plugged into the end socket 7 on main cable 2 has a switch S electrically connected therein.

Figure 2:
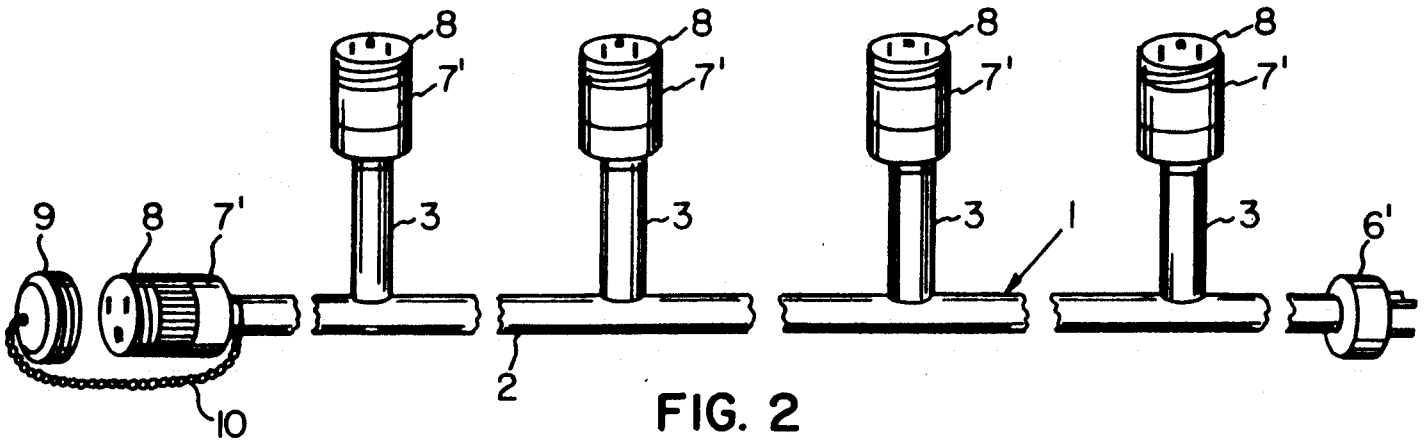
FIG. 2 is a second embodiment of a multiple outlet extension cord.

The modification of the invention shown in FIG. 2 of the drawings has a polarized plug 6' at one end of the main cable and a polarized socket 7' with external threads 8 electrically connected to the end of the main cable and to the distal end of each pigtail 3. External threads 8 are adapted to receive the internal threads on a cap 9 to close the socket when the socket is not in use to prevent moisture, dirt and debris from entering into the openings in the socket. A closure cap 9 is shown attached to socket 7' on the end of the main cable by a short length of chain 10. The construction of the sockets, the closure caps and the connecting chains are well-known to those skilled in the art and form no part of the present invention.

Figure 3:
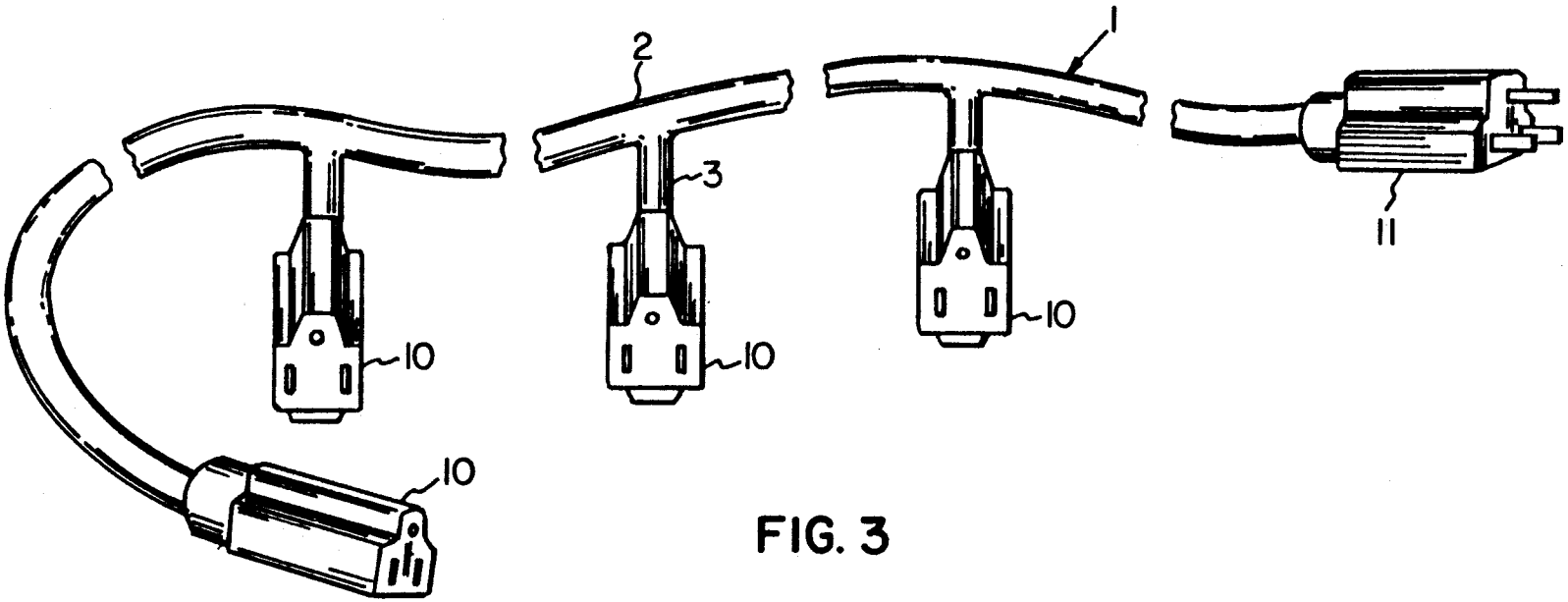
FIG. 3 is a multiple outlet extension cord having spaced pigtails with standard grounded sockets and a grounded plug.

FIG. 3 of the drawings shows a further modification of the extension cord wherein each socket 10 and the plug 11 is shaped in the standard configuration of grounded plugs and sockets wherein the ground opening is in the upper narrow portion of the socket and the two plug receiving slots are in the lower enlarged portion of the socket.

Figure 4:
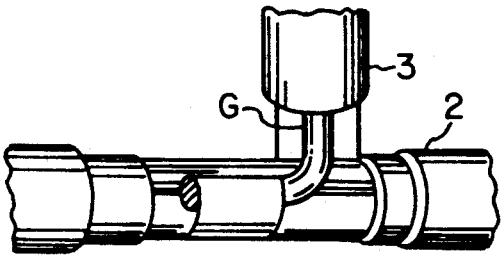
FIG. 4 is a section of main cable wit a pigtail extending therefrom.

FIG. 4 of the drawings shows a section of main cable 2 with a pigtail 3 electrically connected thereto. A ground wire G is shown extending from pigtail 3 and attached along the main cable.

Figure 5:
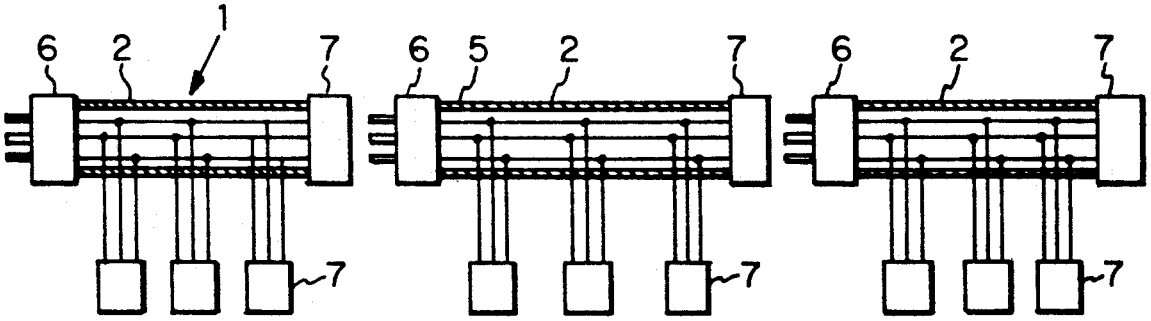
FIG. 5 is a schematic showing a plurality of extension cords which can be attached to an electric outlet or to each other.

FIG. 5 of the drawings shows three extension cords 1 each of which has a plug 6 electrically connected at one end, a socket 7 electrically connected at the other and three pigtails spaced along the length of the main cable with sockets 7. The individual wires in each pigtail 3 are connected in parallel to a positive wire, a neutral wire and a ground wire in the main cable. The cable covering 5 and the exteriors of plug 6 and sockets 7 can be made from anyone of the following synthetic materials, polypropylene, low-density polyethylene, polyorganosiloxanes such as polydimethylsiloxane, polyethylene terephthalate, poly-cis-1,4-isoprene, poly-trans-1,4-isoprene, or polybisethoxyphosphazine. All of these materials are water resistant so that the extension cord can be used out of doors in wet weather.

While specific embodiments of the invention have been described in detail herein, it will be appreciated by those skilled in the art that various modifications and alternatives to those embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. An electric extension cord comprising an elongated flexible main cable having a first end and a second end, an electric plug electrically connected to said first end of said main cable, an electric socket electrically connected to said second end of said main cable, a plurality of elongated flexible pigtails having an end electrically connected at spaced intervals along said main cable between said first end and said second end having a distal end, an electric socket electrically connected to said distal end of each of said pigtails, whereby said extension cord may be utilized to conduct electricity to a plurality of electricity consuming devices by plugging said plug on said first end of said extension cord into an electric outlet and connecting an individual electricity consuming device to each of said sockets.

2. An electric extension cord as set forth in claim 1 including a synthetic waterproof covering on said main cable, said pigtails, said plug and each of said sockets, whereby said extension cord can be used in wet conditions.

3. An electric extension cord as set forth in claim 1 wherein each of said sockets is formed with external threads and a closure cap attached to each of said closure caps having internal threads adapted to cooperate with said external threads on one of said sockets, whereby said internal threads on each of said caps are screwed on said external threads on each of said sockets to close the end of said socket when said socket is not in use to prevent moisture, dirt and debris from entering into openings in each of said sockets.

4. An electric extension cord as set forth in claim 1 wherein said main cable includes a hot wire, a neutral wire and a ground wire and each of said pigtails has a hot wire connected to said hot wire in said main cable, a neutral wire connected to said neutral wire in said main cable and a ground wire connected to said ground wire in said main cable.

5. An electric extension cord as set forth in claim 4 wherein said wires in said main cable and said wires in each of said pigtails are connected in parallel.

6. An extension cord as set forth in claim 1 wherein said protective covering on said main cable and said pigtails is selected from one of the following synthetic materials, polypropylene, low-density polyethylene, polyorganosiloxanes such as polydimethylsiloxane, polyethylene terephthalate, poly-cis-1,4-isoprene, poly-trans-1,4-isoprene, or polybisethoxyphosphazine.

* * * * *